US005213324A

United States Patent [19]

Bowers

[11] Patent Number: 5,213,324

[45] Date of Patent: May 25, 1993

[54] PRACTICE SLEEVE AND BALL

[76] Inventor: Glen H. Bowers, 766 Plaza Hermosa, Novato, Calif. 94947

[21] Appl. No.: 804,104

[22] Filed: Dec. 6, 1991

[51] Int. Cl.[5] ..... A63B 69/40

[52] U.S. Cl. ..... 273/26 R; 273/29 A; 273/DIG. 30; 273/186.5

[58] Field of Search ..... 273/26 B, 58 A, 72 R, 273/323, 327, 324, DIG. 30, 346, 412, 67 R

[56] References Cited

U.S. PATENT DOCUMENTS

| | | | |
|---|---|---|---|
| 3,618,945 | 11/1971 | Kuchar | 273/26 B |
| 3,833,217 | 9/1974 | Greaney | 273/26 B |
| 4,303,247 | 12/1981 | Fain | 273/324 |
| 4,511,139 | 4/1985 | Armstrong | 273/26 B |
| 4,789,161 | 12/1988 | Waskelo | 273/26 B |
| 4,826,173 | 5/1989 | Brown | 273/186 E |
| 4,930,772 | 6/1990 | Maloney et al. | 273/26 B |
| 5,026,284 | 1/1991 | Novosel | 273/186 E |
| 5,080,374 | 1/1992 | Yu et al. | 273/327 |
| 5,082,284 | 1/1992 | Reed | 273/186 E |

FOREIGN PATENT DOCUMENTS

| | | | |
|---|---|---|---|
| 699300 | 12/1964 | Canada | 273/26 B |
| 2575075 | 6/1986 | France | 273/186 E |

*Primary Examiner*—Theatrice Brown
*Attorney, Agent, or Firm*—Kathleen A. Skinner

[57] ABSTRACT

A baseball practice device with a sleeve for a bat and a lightweight ball which can be caught on the sleeve. The sleeve has a catching surface covered with one component of a two-component hook and loop fastening system and the ball has an outer cover covered with the second component of the fastening system. The catching surface corresponds to a predetermined hitting zone so that when one swings a bat with the practice sleeve against a ball of the practice device, the ball will contact the catching surface and the accuracy of the swing will be immediately apparent.

6 Claims, 3 Drawing Sheets

PRACTICE SLEEVE AND BALL

BACKGROUND OF THE INVENTION

1. Field of the Invention

The present invention relates to the field of batting practice devices and, more particularly, to a sleeve which is placed on a conventional bat to train a person using the bat to contact a ball in the preferred hitting zone of the bat.

2. Description of the Prior Art

Baseball, softball, and the like, are games involving hitting a ball with a bat. In order for a person to become proficient at hitting a ball with a bat, it is necessary for a player to practice making contact between the ball and the bat in order to develop the desired hand-eye coordination. To become proficient and hit the ball with the most power, a player must be able to swing the bat in a level manner through a given plane and hit the ball at a preferred hitting zone on the bat. When the ball is struck by the bat in this location, it will be projected in a straight line and travel the furthest distance possible from the batter. This area of the bat, which is on the face of the bat near the end, is frequently called the "sweet" part of the bat. It has been found that most of the power of the batter will be transferred to the ball if the ball contacts this spot on the bat, rather than merely glancing off the end or another portion of the bat.

It is thus desirable, especially for youngsters and amateur baseball players, to develop the hand-eye coordination to be able to line up this preferred part of the bat with the ball; and to develop this coordination, frequent practice is necessary. However, in order to practice with a standard bat and ball, it is usually necessary to have other players pitch and field the ball and to have a large field for the ball to travel. In order to measure one's success in properly hitting the ball with a standard ball and bat, a player must watch the distance and placement of the ball in the field.

Various practice aids have been developed to train players to focus on desirable techniques of their swing. One of these aids is a V-shaped sleeve, shown in U.S. Pat. No. 3,833,217, which is attached to a conventional bat; the bat is then used to strike a standard ball. This device, however, requires someone to retrieve the ball and, if a batting tee platform is not used, it also requires a pitcher.

A number of other prior art devices require specially constructed bats, including U.S. Pat. No. 3,618,945 (which has cushions to block out the "non-sweet" areas of the bat); U.S. Pat. No. 4,511,139 (which adapts the bat to add a hinged portion); and U.S. Pat. No. 4,930,772 (which calls for ball-shaped indentations in the bat). In most of these devices, the bat must be permanently adapted for training purposes and is no longer useful as a playing bat. Although one embodiment of Pat. No. 3,618,945 provides for removable sleeve portions to cushion the non-preferred zones of the bat, that device fails to provide for a means for capturing or retrieving the ball. U.S. Pat. No. 4,789,161 provides specialized catching and retrieving components in which the ball is retained temporarily by a surface of hook and loop fasteners on the bat before it is propelled back to the other player. This device, however, is not designed for experiencing the feel of swinging one's personal bat, or even a full-size bat, nor for developing an eye for a particular hitting zone on a conventional bat, nor is it useful for batting practice by oneself.

Thus, there has been a need, which has not been fulfilled by the prior art, for a baseball practice device which allows a player, and particularly a young player, to practice swinging a bat to develop precision in hitting a ball in the preferred hitting zone of the bat so that he or she will ultimately be able to drive the ball accurately and powerfully in a real game. There has been a need for a practice device which can be used with a conventional bat so that the true weight and feel of the bat is not changed. There is also a need for a batting device which allows the batter to practice in an enclosed or relatively small space without danger of injury to himself or others or damage to the surroundings, and one which additionally allows the batter to clearly and easily observe the results of his or her swing.

This invention provides a solution to these needs by providing a sleeve which can be removably attached to a conventional bat, and which has a catch means which can correspond to the "sweet" area of the bat. This sleeve allows a player to practice batting with a lightweight ball which can be either thrown by another player or mounted on a batting tee so that a batter can practice without any other participants. The sleeve provides means for capturing the ball where it was struck so that immediate visual observation is possible to determine whether a swing struck the ball in the preferred hitting zone or not.

SUMMARY OF THE INVENTION

The present invention is a baseball practice aid which includes a sleeve for a bat and a lightweight ball which can be caught on the sleeve. The sleeve, which is removable and may be used with a standard bat, is provided with catch means which includes a catching surface disposed in a preferred hitting zone and covered with the first component of a two-component hook and loop fastening system. The catching surface in one embodiment includes a panel-shaped surface and in another embodiment the catching surface is comprised of catching members. The ball has an outer cover substantially covered with the second component of the two component fastening system. Thus, when the ball is properly contacted by the bat, the fastening system will cause the ball to be retained on the sleeve.

One object of this invention is to provide a batting practice aid which can be easily placed on, and removed from a standard bat, thus allowing the user to experience the weight and size of a standard bat during practice and providing a simple, portable device which does not permanently change the bat. Another object of this invention is to provide a practice aid with a lightweight ball which can be used with a batting tee, thus allowing the batter to practice alone and in a confined area, if necessary, without fear of breakage or injury. The same practice aid can also be used, even by professional players with another player in soft toss drills. Another important object of this invention is to capture the ball if the bat strikes it in the predetermined area of the bat so that the player can immediately determine if the ball had contacted the "sweet" area of the bat or if it were outside and can then modify his or her swing. Other objects and advantages of the invention will become apparent when it is considered in conjunction with the accompanying drawings described hereafter.

DESCRIPTION OF THE PREFERRED EMBODIMENT

Figures 1, 5:
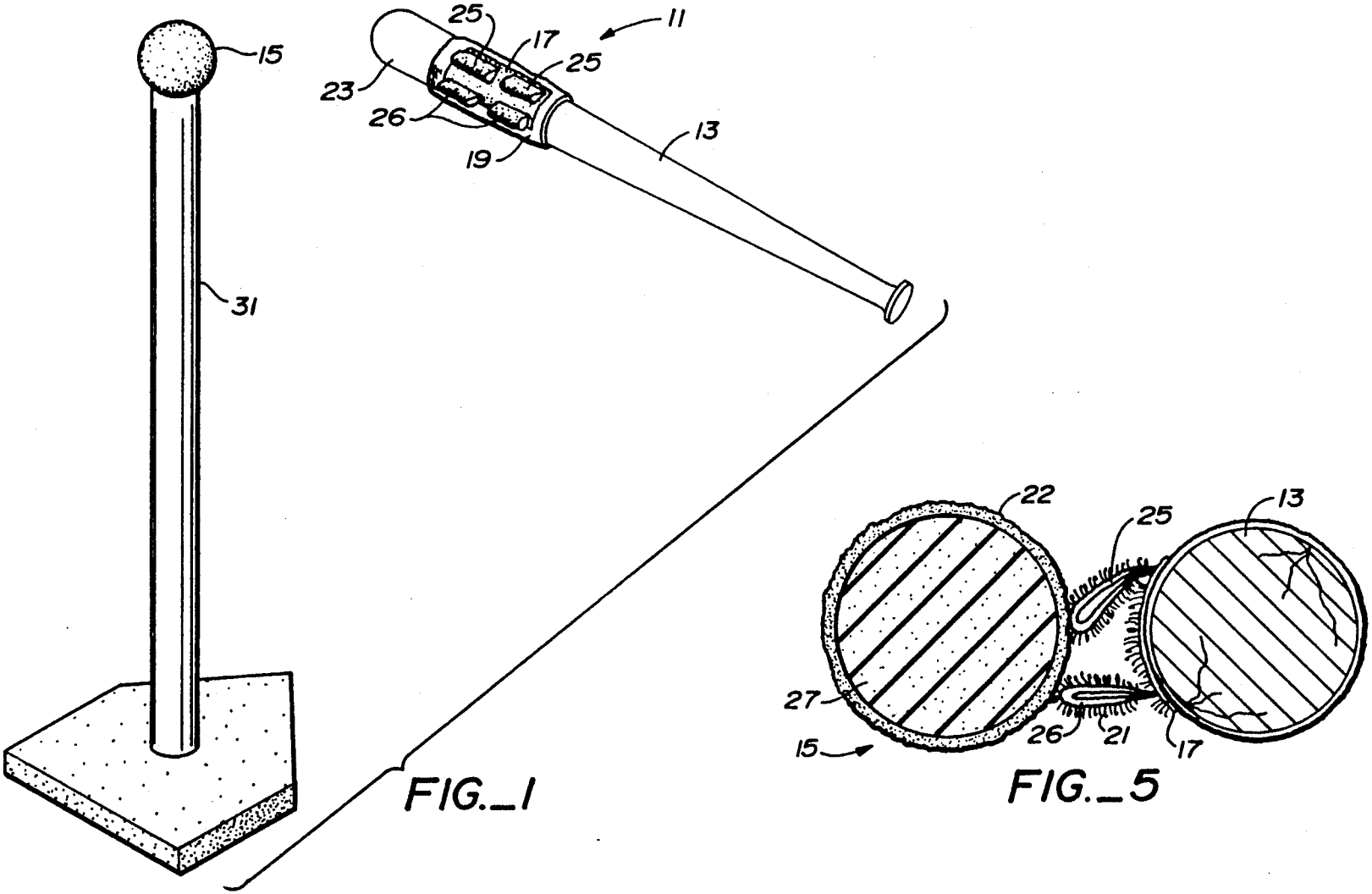
FIG. 1 is a perspective view of one embodiment of the sleeve and ball of this invention, illustrating one method of use.
FIG. 5 is a cross-sectional view of the invention of FIG. 1 taken along line 5—5 of FIG. 4.

The present invention is a baseball practice device which includes a sleeve 11 for a bat 13 and a ball 15 which can be caught on the sleeve. The sleeve includes catch means having catching surface 17 which releasably adheres to the outer surface of the ball so that the ball can be retained on the sleeve in certain positions. In the baseball practice device of this invention, the catching surface of the sleeve is preferably covered with one component 21 of a two component hook and loop fastening system and the ball is covered in substantial part with the second component 22 of the fastening system, thus permitting the ball to releasably adhere to the portion of the sleeve which is covered with the first component. While Velcro ® fasteners are specifically contemplated, any equivalent fastening system which allows the alternate capture and release of the components of the practice aid could be used.

The sleeve 11 may be constructed of any flexible elastic material 19 which can be secured onto the bat 13 when practice is desired and yet removed from it easily when the bat is needed for regular play. In the preferred embodiment, the sleeve is constructed in the form of a band of a closely knit elastic material 19 which completely surrounds a longitudinal portion of the bat near the striking end 23 of the bat. This sleeve may instead be constructed of a panel of material which is held onto the bat by elastic strips. In any case, it is important that this sleeve fit tightly onto the bat so that the force of the swing and contact with the ball do not dislodge it, but yet it will be removable when the batter wishes to take it off.

Figure 2:
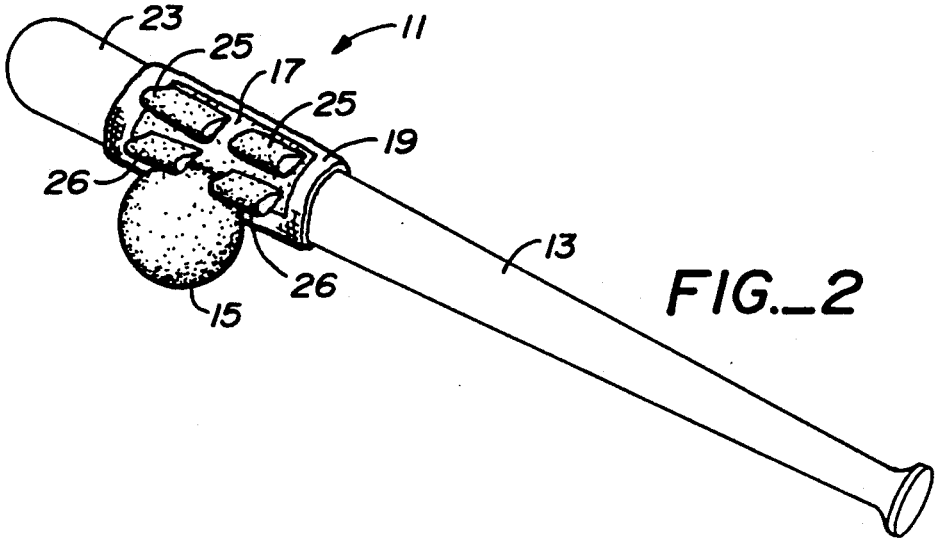
FIG. 2 is a perspective view of the invention of FIG. 1 showing the ball in contact with the catch means of the sleeve.
Figure 3:
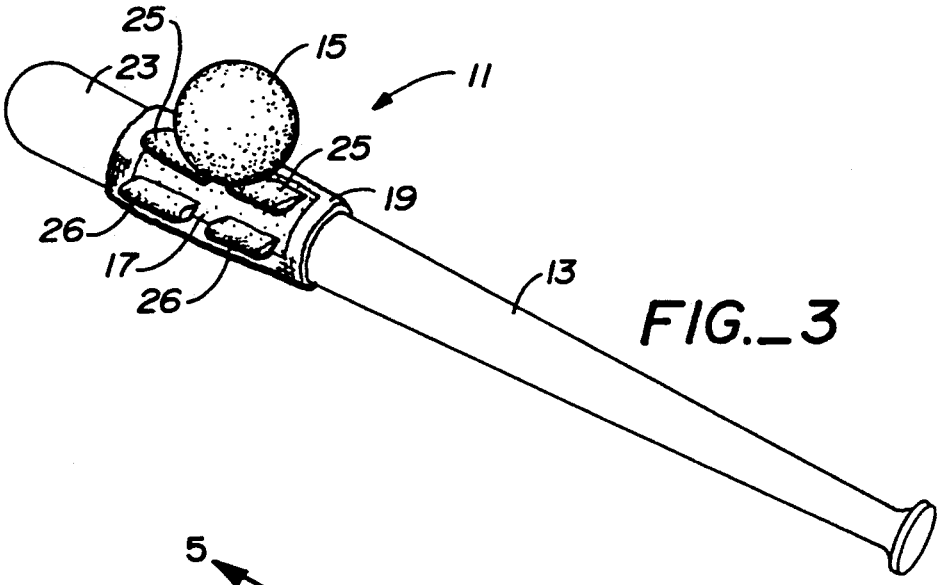
FIG. 3 is a perspective view of the invention of FIG. 1 showing the ball in contact with another portion of the catch means.
Figure 4:
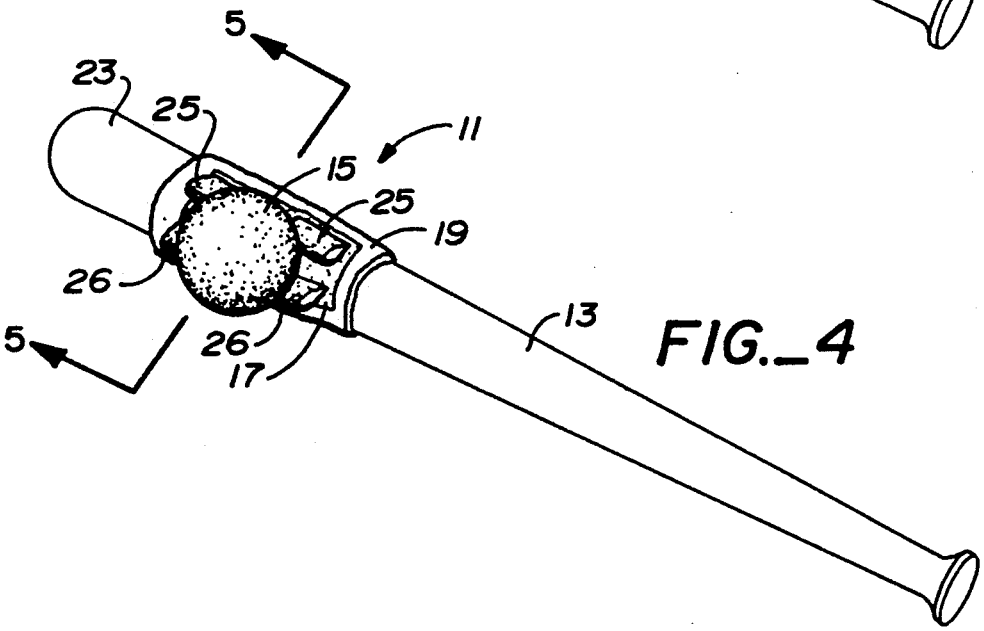
FIG. 4 is a perspective view of the invention of FIG. 1 showing the ball in contact with the catch means in the center of the preferred hitting zone of the bat.

The catch means provided on the sleeve 11 comprises a catching surface 17 having a first component 21 of a two component hook and loop fastening system as mentioned above. The catching surface is disposed on the sleeve to form a target which corresponds to a predetermined hitting zone of the bat when the sleeve is placed on the bat. The predetermined hitting zone is an area at the hitting end of a bat which has been determined by a coach or instructor to be the training area. This hitting zone will generally correspond to the "sweet" area of the bat, which is the location on the bat where, when the ball strikes it directly, the ball will be hit the furthest and truest and with the most power. For a full-sized bat, the "sweet" area of the bat is generally a rectangular section which starts at approximately 3" from the striking end 23 of the bat. Depending upon the type and length of the bat and the opinion of the person consulted, the sweet area of the bat may extend from 3"–6" along the longitudinal length of the bat. The width of this preferred hitting zone for a full-sized bat may be from 1"–2" wide. The dimensions of the preferred hitting zone may differ, depending upon the length, diameter and weight of the bat, and also may vary according to the opinion of the baseball coach or expert consulted. Moreover, the dimensions of the predetermined hitting zone need only correspond generally with the preferred hitting zone. The catching surface may actually be sized to expand this area, for example, to encourage starting players, or to restrict this area to encourage an even more precise swing. The catching surface will usually be larger than the true target area, because the hitter can visually determine from the place of contact, whether the ball was accurately caught in the middle of the zone, such as is illustrated in FIG. 4, or if the swing was somewhat high or low, as shown in FIGS. 2 or 3.

Figure 7:
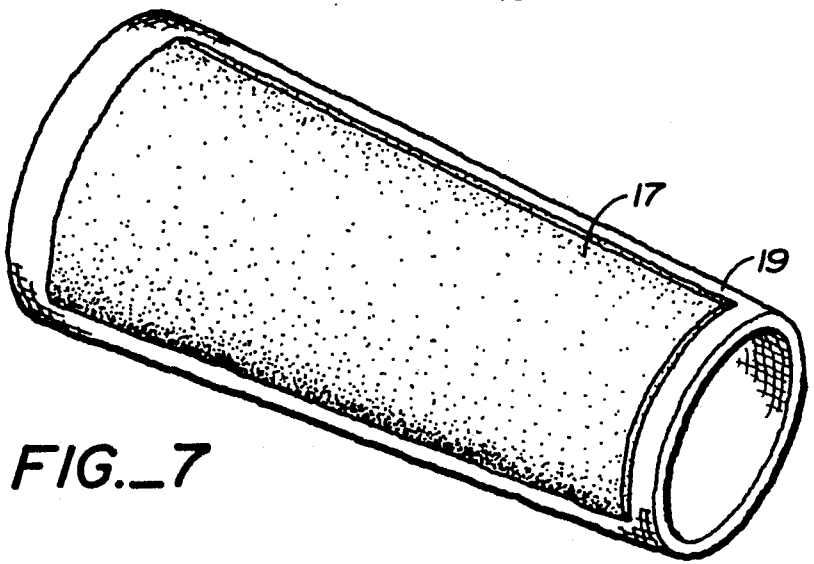
FIG. 7 is a perspective view of another embodiment of the sleeve.

The sleeve 11 is placed on the end of the bat so that the catching surface is aligned with this predetermined hitting zone. In one embodiment, the catching surface may be in the form of a panel shaped to correspond to this zone and attached to the exterior surface of the sleeve. The size of the panel may be varied with some latitude to conform to different lengths, or widths. In the embodiment illustrated in FIGS. 1–6, the surface of the panel is approximately 2" wide by 5" long. In the embodiment of FIG. 7 the width is greater. It is not intended that this invention be limited to any definite size, however.

In another embodiment, the catch means 17 further includes at least two catching members 25, 26 projecting from the sleeve 11 proximate the predetermined hitting zone. The projecting catching members may be used to absorb the force of the contact with the ball, especially if it is struck with a lot of force, or if the bat is rolled at the time of contact. The catching members also extend the catching surface for capturing the ball. These projecting catching members may be flexible flaps disposed in opposed relationship proximate the outer edges of the surface of the predetermined hitting zone. The flaps have a ball-contacting surface which is covered with the first component 21 of the two component hook and loop fastening system. The flaps may consist of strips of Velcro ® component looped so that the fastening component is on the exterior of the loop. The flaps may be either a single flap or a series of flaps disposed parallel to the longitudinal axis of the bat and the flaps may be of any length (the length being measured along the longitudinal dimension of the catching surface). Preferably, the flaps extend along most of the longitudinal edges of the panel-shaped portion of the catching surface. The flaps are anchored at the outer portion of the predetermined hitting zone, to either the sleeve or to the panel. In the embodiment shown in FIGS. 1–6 the flaps project approximately 1" to 1¼" from the sleeve, but this distance can vary, depending upon the extension of the catching surface and the degree of shock absorption desired.

Figure 8:
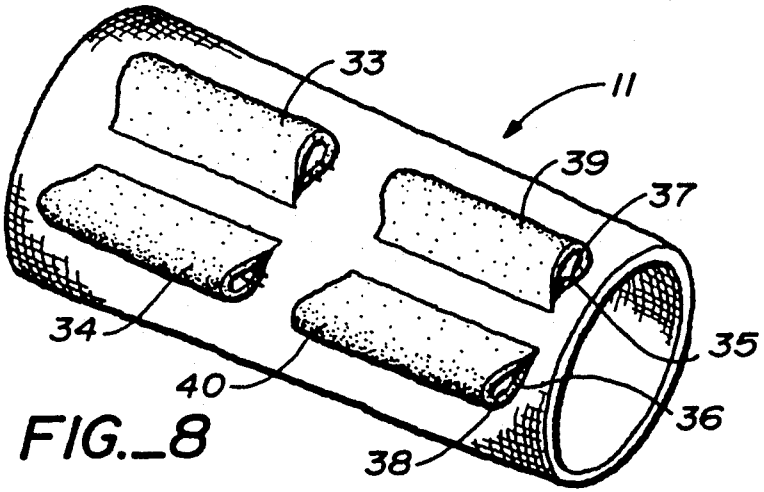
FIG. 8 is a perspective view of another embodiment of the sleeve.
Figure 9:
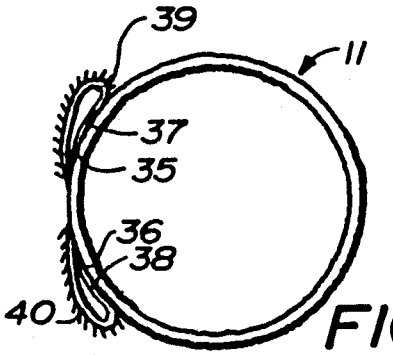
FIG. 9 is an end view of the sleeve of FIG. 8.
Figure 6:
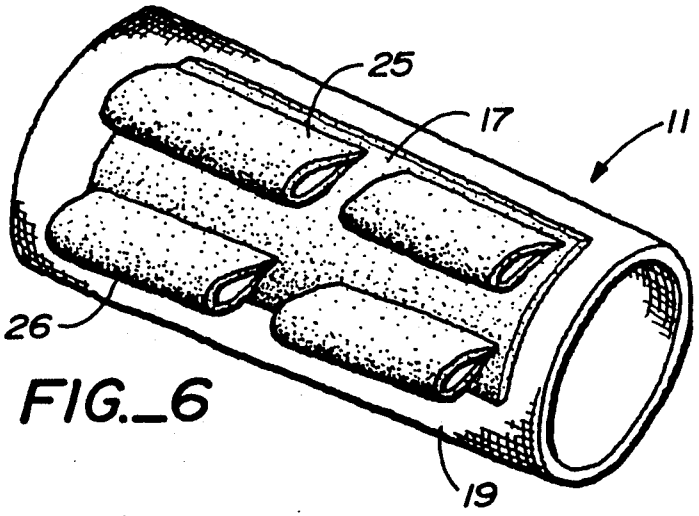
FIG. 6 is a perspective view of the sleeve of FIG. 1.

In another embodiment of this invention, the catching surface 17 of the sleeve 11 may be formed from catching members 33, 34 disposed in opposed relation proximate the predetermined hitting zone, with the catching members having ball-contacting portions covered with the first component of the two component hook and loop fastening system. The catching surface in this embodiment, illustrated in FIGS. 8 and 9 utilizes catching members which project only partially from the surface and are used to capture the ball without an underlying panel. These catching members may be formed in loops, as described above, and placed in opposed relation close enough together so that a ball contacting the center of the predetermined hitting zone will necessarily be captured. In this embodiment each loop is anchored to the outer surface of the sleeve at points 35, 36 and 37, 38 so that the loops will not freely flap back and forth as in the embodiment shown in FIGS. 1–6, but will provide an extended catching surface and a raised shock absorption portion 39, 40 at the outer edges of the predetermined hitting zone.

The baseball practice device of this invention also includes a ball 15 which has a lightweight core 27 and an outer cover 29 with the second component 22 of the hook and loop fastening system disposed over a substantial portion of the cover. The ball may be constructed from a lightweight sponge material, such as Nerf® material. In order for the ball to be pitched to the bat, it needs to be heavy enough to be carried through the air, yet it should be lightweight enough to be retained by the hook and loop fastening system. If the ball is primarily to be used with a batting tee 31, such as that shown in FIG. 1, a lighter ball is more desirable since it will more easily be retained by the catch means on the sleeve. The weight of the ball can be varied by modifying the weight of the core and/or the cover, depending on its primary usage (i.e., for soft toss drill or stationary tee placement).

The sleeve 11 is preferably constructed by sewing a panel 17 of the desired size of the loop component of the Velcro® fasteners 21 onto the elastic material 19 of the sleeve. The projecting catching members, or flaps 25, 26, may be loops formed from loops of strips of the same component of the Velcro® system as is the catch means 17 of the sleeve. These loops may be attached in opposed relation along the outer edges of the panel or in a position so that they will extend when opened to the outer edges of the preferred hitting zone along its longitudinal dimension. The length of the flaps ma extend for the full length of the preferred hitting zone on each side or one may use a plurality of shorter flaps on each side to extend for most of this distance. These flaps are desirable in some applications for cushioning and securing a ball which comes in contact with the sleeve of the bat.

Therefore, the ball 15 of this practice device may be placed on a tee 31 as shown in FIG. 1 and the batter may stand near it in proper batting position, lining the bat up to swing against the ball. Alternatively, the ball may be pitched or tossed to the batter and the batter may swing in a normal fashion. If the bat hits the ball outside the catching surface, or if the ball has only grazing contact with the Velcro® component of the catching surface or the flaps, the ball will be deflected off and not retained by the catch means. If the ball contacts the surface of the flaps as seen in FIGS. 2 or 3, the ball will be seen to have hit only the outer edges of the preferred hitting zone. However, if the ball is captured in the middle of the catching surface and lined up with the flaps as seen in FIGS. 4 and 5, the batter will experience positive reinforcement from observing successful contact with the ball and will be encouraged to repeat the motion that caused this result.

Thus, it can be seen that this baseball practice device may be easily constructed. It may also be used quite simply by stretching the sleeve over the hitting end of the bat aligning it with the preferred hitting zone of the bat, and then swinging the bat at the ball, whether it is thrown or placed on a tee for batting practice. This invention thus makes it possible for someone to adapt a conventional bat of standard size and weight for use in training to develop a proper swing and the hand-eye coordination necessary to align a ball with the "sweet" part of the bat. The catching means on the sleeve of this device enables the ball to be easily captured if it is struck in the proper location and retains it in place for observation. Because the ball is lightweight, it is possible to use this practice device in confined spaces and without risk of injury or damage to the surroundings. It also enables one to practice more frequently since one need not depend on someone to pitch or retrieve the ball during the practice. Thus, this practice aid provides a solution to the need for baseball players to practice their batting skills and develop precision in their hand-eye coordination easily and at their own convenience, as frequently as they like and without permanently adapting a standard bat. Thus, it can be seen that the present invention will achieve all the advantages and objects attributed to it and while it has been described in detail, it is not to be limited to such details except as may be necessitated by the appended claims.

I claim:

1. A batting practice device comprising a removable sleeve sized for securement on a bat, said sleeve comprising catch means on its outer surface, said catch means being disposed on the outer surface of said sleeve for alignment with a predetermined hitting zone of a bat on which said sleeve may be placed, said catch means comprising at least two projecting members and a first component of a two component hook and loop fastening system disposed on said projecting members; and a ball comprising a lightweight core and an outer cover having a surface substantially covered with a second component of the hook and loop fastening system, so that said ball may adhere to said projecting members on said sleeve.

2. The baseball practice device of claim 1 wherein the sleeve comprises an elastic portion and said catch means further comprises a panel having a first component of said fastening systems and being attached to the exterior surface of the sleeve and shaped to form a target area corresponding to a predetermined hitting zone of a bat on which said sleeve may be placed.

3. The baseball practice device of claim 1 wherein said projecting members are flaps disposed in opposed relationship proximate the outer edges of said predetermined hitting zone.

4. A baseball practice device comprising (a) a removable sleeve sized for securement on a bat proximate a preferred ball-contacting portion of a bat, said sleeve comprising an elastic generally tubular portion and catch means, said catch means comprising a catching surface integrally attached to the exterior surface of said sleeve, said catching surface comprising a panel shaped portion having a predetermined area and at least two flexible flaps projecting in opposed relation from the sleeve proximate said panel shaped portion, said at least two flaps being substantially covered with a first component of a two component hook and loop fastening system; and (b) a ball comprising a lightweight core of spongy material and an outer cover substantially covered with a second component of said hook and loop fastening system so that the ball may adhere to the catching surface.

5. The baseball practice device of claim 4 wherein said flaps are disposed generally along the perimeter of said panel parallel to the longitudinal axis of a bat when placed thereon.

6. The baseball practice device of claim 4 wherein the flaps are formed as loops having an exterior surface covered with the first component of the hook and loop fastening system.

* * * * *

UNITED STATES PATENT AND TRADEMARK OFFICE

CERTIFICATE OF CORRECTION

PATENT NO. : 5,213,324

DATED : May 25, 1993

INVENTOR(S) : Glen H. Bowers

It is certified that error appears in the above—identified patent and that said Letters Patent is hereby corrected as shown below:

Col. 5, line 45, "ma", should read --may--.

Col. 6, claim 2, line 49, "systems" should read --system--.

Signed and Sealed this

Fourteenth Day of December, 1993

Bruce Lehman

*Attest:*

BRUCE LEHMAN

*Attesting Officer*

*Commissioner of Patents and Trademarks*